United States Patent [19]

Clements et al.

[11] 4,257,138

[45] Mar. 24, 1981

[54] AUTOMATIC DEVICE FOR WASHING WINDOWS

[76] Inventors: Nicholas Clements, 23 Charlton St., New York, N.Y. 10014; Richard L. Miller, 12 Parkside Dr., Dix Hills, N.Y. 11746

[21] Appl. No.: 59,981

[22] Filed: Jul. 23, 1979

[51] Int. Cl.[3] ..... A47L 1/02

[52] U.S. Cl. ..... 15/4; 15/50 C; 15/103; 15/250.03

[58] Field of Search ..... 15/21 E, 49 C, 50 C, 15/98, 103, 246, 250 R, 250.01, 250.02, 250.03, 250.04

[56] References Cited

U.S. PATENT DOCUMENTS

| | | | |
|---|---|---|---|
| 2,563,696 | 8/1951 | Wayne | 15/250.03 |
| 2,740,151 | 4/1956 | Wayne | 15/250.03 |
| 3,298,052 | 1/1967 | Wolfe | 15/98 X |
| 3,425,082 | 2/1969 | Hetman | 15/103 X |
| 3,454,976 | 7/1969 | Kijinski | 15/103 X |

FOREIGN PATENT DOCUMENTS

| | | | |
|---|---|---|---|
| 2748142 | 5/1979 | Fed. Rep. of Germany | 15/250.11 |

*Primary Examiner*—Edward L. Roberts
*Attorney, Agent, or Firm*—Richard L. Miller

[57] ABSTRACT

An electrically powered apparatus for automatically washing and wiping an outer side of a building window; the apparatus including a horizontal rotary brush rotating against the window and at the same time being vertically carried on vertical screws turned by an electric motor, a detergent solution supply tank above the window being contacted by the brush at its upper limit of travel so to fill a chamber inside the brush from which the solution is gradually dispensed to the brush bristles, a wiper blade above and below the brush wiping the window dry of the solution.

2 Claims, 6 Drawing Figures

M.
SW.

AUTOMATIC DEVICE FOR WASHING WINDOWS

BACKGROUND OF THE INVENTION

This invention relates generally to window washing machinery. It is well known that many tall buildings depend upon a person serving as a window washer to strap himself outside of the window for washing the same. This is dangerous work and is time consuming to accomplish, so is therefore in need of an improvement.

SUMMARY OF THE INVENTION

Therefore it is a principal object of the present invention to provide a window washing device that washes and wipes a window automatically so as to eliminate need of a man to step outside of a window, and risk fall, in such dangerous work.

Still another object is to provide a window washing device which can be entirely automated and operated by a computer programed for such.

BRIEF DESCRIPTION OF THE DRAWING FIGURES

The Figures on the drawings are briefly described as follows.

DETAILED DESCRIPTION OF PREFERRED EMBODIMENT

Figures 1, 2, 3, 4, 5, 6:
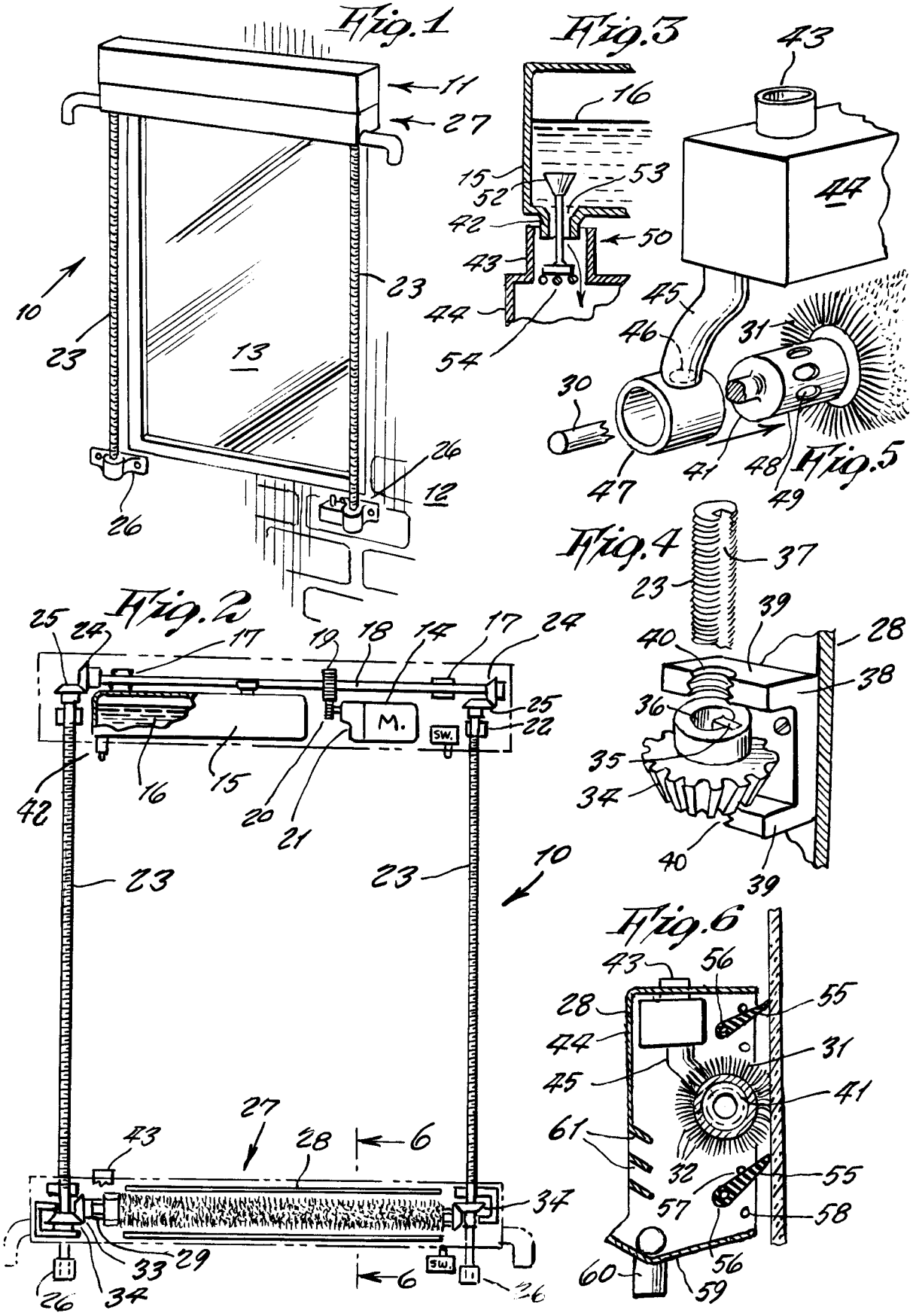
FIG. 1 is an outside perspective view of a building window with the present invention installed thereon.
FIG. 2 is a diagrammatic front view of the mechanism thereof.
FIG. 3 is a detail of the transfer means of the cleaning fluid between a reservoir tank above the window and a tank on the elevator unit.
FIG. 4 is a detail of the drive for moving the elevator unit up and down.
FIG. 5 is a detail of the structure for transfering the fluid from the elevator unit tank to the rotating brush.
FIG. 6 is a cross sectional view on line 6—6 of FIG. 2.

Referring now to the drawing in greater detail, the reference numeral 10 represents an automatic window washing device according to the present invention, wherein there is a stationary case 11 permanently mounted to an outer side surface of a building wall 12 at a location above a building window 13.

Inside the case there is mounted a two directional electric motor 14 and a tank 15 which can be filled with a detergent solution 16 from the rear side by a person standing inside the room or an additional automated system not shown. Controls to the motor may likewise be accessible or by a wall switch inside the room.

Bearing brackets 17 mounted inside the case, support rotatably free a horizontal shaft 18 having a gear 19 affixed thereupon engaging a gear 20 of a gear reduction 21 driven by the motor. Additional bearing brackets 22 support rotatably free the upper ends of vertically extending screws 23 which hang downwardly out a bottom of the box and along the side edges of the window so as to not block a view therefrom. A bevel gear 24 affixed on each end of shaft 18 engage a gear 25 on an upper end of each screw. A lower end of each screw is supported rotatably free in a bearing bracket 26 mounted stationarily directly to the building wall.

A horizontal, operational arm 27 is supported between the screws and is movable up and down in front of the window.

The arm comprises a case 28 having bearing brackets 29 inside that support rotatably free the opposite ends 30 extending from a hollow core of a rotary brush 31 having radically extending brush bristles 32.

Each end 30 has a bevel gear 33, affixed thereto, engaging a bevel gear 34 that is rotatably affixed but axially slidable on the screw 23 by means of the construction shown in FIG. 4 which shows a key 35 affixed in a clearance hole 36 of the gear 34 being slidable in a keyway 37 along the entire screw threaded portion of screw 23.

A U-shaped bracket 38 affixed to an inside of the case 28 enclosing the rotary brush retains the gear 34 between its upper and lower ribs 39. A threaded opening 40 in each rib engages the screw 23.

The hollow core of the brush serves as a reservoir 41 into which the detergent solution is transferred from the tank 15, when the arm is moved upwardly adjacent to case 11. A downward projecting spout 42 from the tank fits inside a filler opening 43 of a small container 44 mounted inside the arm case 28. This engagement pushes a spring-biased valve inside the spout so to open up and pour a controlled quantity of the detergent out of the tank. Thereafter the valve closes so that when the arm is moved away from the case 11, the spout does not continue to drip.

A pipe 45 from container 44 carries the detergent to an opening 46 in a collar 47 inside which one end 48 of the reservoir 41 rotates. A circle of holes 49 around the reservoir end 48 transfers the detergent from the pipe 45 to the reservoir interior. The reservoir extends a full length of the brush and the reservoir side wall is perforated with small openings throughout its full length so that the detergent is dispersed therefrom to all of the brush bristles.

It is to be noted that the brush is sufficiently close to the window pane so that the brush bristles are flexed as they brush thereacross. This eliminates need of any complicated adjusting means for maintaining the brush in engagement with the window pane.

FIG. 3 illustrates the automatic shut off valve 50 of the tank 15. It includes a vertically slidable shaft 51 with conical valve head 52 at its upper end for seating on a conical valve seat 53, when the shaft is allowed to freely drop. A grid 54 comprised of a screen or the like is inside the filler pipe 43 and serves to lift the valve head off the seat so that the detergent flows outward at such time out of the tank.

In operative use, it is now evident that as the screws rotate, the brush is also rotated while the arm is vertically moved up (or down, depending upon motor rotation direction). Thus the detergent wetted bristles wash the window in upward and downward travel of the arm.

A wiper blade 55 above and below the brush are each pivotable about a pivot pin 56 so to pivot upward during downward arm travel, and pivot downward during upward arm travel and wipe the window pane dry after the brushing action. Pins 57 and 58 limit the pivotal travel of the wiper blades.

A gutter 59 formed along a bottom wall of the case 28 serves to catch the detergent running down off the brush and blades after use. A down spout 60 at each end lets the detergent to run out of the case a spaced distance away from the window pane in order to not run down the same and deface it.

The case additionally may be provided with louvers 61, as shown in FIG. 6, so to allow sunlight and rain to enter and wash out the gutter of detergent residue and then dry it out.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

We claim:

1. A window-washing device, comprising in combination, a case mounted outside a building wall and above a window, a rotatable screw adjacent each side edge of said window extending downwardly from said case, a two directional motor inside said case for rotating said screws, and a horizontal arm vertically movable between said rotating screws, said arm containing a rotatable brush that brushes across said window; a pivotable wiper blade above and below said brush for wiping across said window; a detergent solution tank inside said case, and means for transfer of said solution to said brush, said means including a solution-receiving container in said arm, a filler pipe of said container engaging a downward spout of said tank when said arm is in uppermost position, and a pipe from said container communicating with a collar in which a perforated core of said brush is journalled so as to transfer said solution inside said brush, and a first bevel gear on each opposite end of said core engaging a second bevel gear rotationally secured to each said screw but axially slidable respective thereto, each said second gear being retained between parallel ribs of a U-shaped bracket secured in said arm, and a threaded opening in each said rib engaging said screw.

2. The combination as set forth in claim 1 wherein said arm includes a gutter to catch said detergent after use, and downspouts from said gutter so to direct said detergent from dripping down said window.

* * * * *